US008518196B2

(12) United States Patent
Hahma

(10) Patent No.: US 8,518,196 B2
(45) Date of Patent: Aug. 27, 2013

(54) MISSILE HAVING A PYROTECHNIC CHARGE

(75) Inventor: Arno Hahma, Henfenfeld (DE)

(73) Assignee: Diehl BGT Defence GmbH & Co. KG, Ueberlingen/BRD (DE)

( * ) Notice: Subject to any disclaimer, the term of this patent is extended or adjusted under 35 U.S.C. 154(b) by 315 days.

(21) Appl. No.: 12/879,661

(22) Filed: Sep. 10, 2010

(65) Prior Publication Data

US 2011/0168047 A1 Jul. 14, 2011

(30) Foreign Application Priority Data

Sep. 11, 2009 (DE) ..... 10 2009 041 366

(51) Int. Cl.
*D03D 43/00* (2006.01)

(52) U.S. Cl.
USPC ..... 149/2; 149/37; 149/44; 149/108.2; 149/109.2; 149/109.4

(58) Field of Classification Search
USPC ..... 149/2, 37, 44, 108.2, 109.2, 109.4
See application file for complete search history.

(56) References Cited

U.S. PATENT DOCUMENTS 1,817,503 A * 8/1931 Anderson ..... 102/340
3,877,376 A * 4/1975 Kupelian ..... 102/492
4,719,857 A * 1/1988 Spring ..... 102/335
4,880,483 A * 11/1989 Baldi ..... 149/6
6,178,865 B1 * 1/2001 Roberts ..... 89/36.01
2003/0015265 A1 * 1/2003 Jones ..... 149/19.3
2008/0035007 A1 2/2008 Nielson et al.
2009/0050245 A1 * 2/2009 Lay ..... 149/5

OTHER PUBLICATIONS

Klapötke, Thomas: "Chemie der Hohenergetischen Materialien" (Chemistry of High-Energy Materials) vol. 1, Berlin, Walter de Gruyter, Jun. 4, 2009, Chapter 2.5.3, Decoy Flares, pp. 52-58, ISBN 987-3-11-020745-3.

* cited by examiner

*Primary Examiner* — James McDonough

(74) *Attorney, Agent, or Firm* — Laurence A. Greenberg; Werner H. Stemer; Ralph E. Locher

(57) ABSTRACT

A missile includes a pyrotechnic charge. The missile is constructed in such a way that the pyrotechnic charge is made to burn deflagratively when the missile is used correctly. The pyrotechnic charge includes a mixture containing at least one metal or a metal alloy as a fuel and at least one metal oxide as an oxidizing agent. The fuel and the oxidizing agent are selected in such a manner that they can react with one another by burning. The mixture is compressed to a density of at least 85% of a theoretical density of the mixture, and the fuel, the oxidizing agent and a quantitative ratio between the fuel and the oxidizing agent are selected in such a manner that a density of the mixture is at least 6 g/cm$^3$.

34 Claims, 2 Drawing Sheets

MISSILE HAVING A PYROTECHNIC CHARGE

CROSS-REFERENCE TO RELATED APPLICATION

This application claims the priority, under 35 U.S.C. §119, of German Patent Application DE 10 2009 041 366.9-15, filed Sep. 11, 2009; the prior application is herewith incorporated by reference in its entirety.

BACKGROUND OF THE INVENTION

Field of the Invention

The invention relates to a missile having a pyrotechnic charge, wherein the missile is constructed in such a way that the pyrotechnic charge is made to burn deflagratively when the missile is used correctly.

It is known to use a missile as a decoy which recreates the flight path of a real aircraft as accurately as possible and in the process produces strong infrared radiation (IR radiation). Irrespective of whether it is a kinematic or driven decoy, it has to be aerodynamically stable so that the flight path of a real aircraft can be recreated as accurately as possible and the desired deception is thereby achieved. In order to achieve that, it has been customary to date to use a so-called nose weight made from metal in the front part of such a missile. That weight can form the nose of the missile or be disposed in the nose of the missile. The weight displaces the center of gravity of the missile forwards and makes the missile heavier overall. A disadvantage of that missile is that the nose weight usually contributes more than 50% of the mass of the missile to be accelerated and, at the end of its use, falls to the ground at high speed and can thereby cause serious damage.

U.S. Patent Application Publication No. US 2003/0015265 A1 discloses a missile having an energy-dense explosive which reacts detonatively. Particles of a reducing metal and a metal oxide within a conventional high explosive are dispersed in the energy-dense explosive. Upon detonation, the reducing metal and the metal oxide combine in an exothermic redox reaction at the detonation speed of the conventional explosive. The formulation has a higher density and a higher energy density than the conventional high explosive alone.

SUMMARY OF THE INVENTION

It is accordingly an object of the invention to provide a missile having a pyrotechnic charge, which overcomes the hereinafore-mentioned disadvantages of the heretofore-known devices of this general type and which provides an alternative aerodynamically stable missile.

With the foregoing and other objects in view there is provided, in accordance with the invention, a missile, comprising a pyrotechnic charge. The missile is constructed in such a way that the pyrotechnic charge is made to burn deflagratively upon designated or correct usage. The pyrotechnic charge includes a mixture containing at least one metal or a metal alloy as a fuel and at least one metal oxide as an oxidizing agent. The fuel and the oxidizing agent are selected to react with one another by burning. The mixture is compressed to a density of at least 85% of a theoretical density of the mixture. The fuel, the oxidizing agent and a quantitative ratio between the fuel and the oxidizing agent are selected to result in a density of the mixture of at least 6 g/cm$^3$.

The high density of the mixture means that the center of gravity of the missile can be set by the positioning of the mixture in such a manner that good flying characteristics are thereby obtained. As a result, the non-reactive nose weight frequently provided for this purpose in the prior art can be dispensed with. The payload of the missile is thereby simultaneously increased, because the pyrotechnic charge present in the missile, in contrast to the nose weight, does not represent an inert mass. Furthermore, the burning of the pyrotechnic charge means that it is possible to prevent a relatively large inert mass from remaining and causing damage when the missile falls to the ground.

By virtue of the provision of an appropriate ignition device, the structure of the missile according to the invention can be such that the pyrotechnic charge is made to burn deflagratively when the missile is used correctly. The ignition device can be either a conventional fuse or a further pyrotechnic charge, which burns before the pyrotechnic charge and the burning of which initiates the burning of the pyrotechnic charge.

If the pyrotechnic charge has an appropriate composition, it can also be ignited by impact and thereby made to burn. In this case, the structure of the missile can be such that the pyrotechnic charge is ignited when the missile strikes an intended target. Irrespective of whether the mixture is ignited by impact or by an ignition device, a person skilled in the art knows how to construct the missile so that the pyrotechnic charge is made to burn deflagratively when the missile is used correctly.

Furthermore, a person skilled in the art knows how to select the fuel and the oxidizing agent so that they can react with one another by burning. For this purpose, he or she combines a metal or a metal alloy as a fuel with a metal oxide as an oxidizing agent, with the metal of the metal oxide having a higher standard potential than the metal or the metal alloy, i.e. in the voltage series, the metal of the metal oxide is above the metal serving as a fuel or the metal alloy serving as a fuel.

The fuel can be present as a powder of at least one metal or of at least one metal alloy or as a mixture of powders of at least one metal and of at least one metal alloy. The oxidizing agent can be present as a powder of at least one metal oxide or of at least one mixed oxide of metals or as a mixture of powders of at least one metal oxide and of at least one mixed oxide of metals.

The mixture can additionally contain at least one binder. This is expedient particularly when it transpires during compression that the mixture does not have good cohesion. Particularly suitable binders are polytetrafluoroethylene (PTFE such as Teflon® which is a trademark of DuPont) and/or fluorinated rubber (Viton® which is also a trademark of DuPont), because these polymers themselves have a relatively high density and simultaneously serve as further oxidizing agents due to their fluorine content of about 70% by weight. However, since the density of the binder is usually less than the density of the fuel and of the oxidizing agent, the binder should be employed in the smallest possible quantity so that the mixture nevertheless still has a high density. The mixture can contain graphite, bentonite, lead powder, tin powder, bismuth powder, indium, glycerol and/or phenolic resin.

According to one embodiment of the invention, the mixture does not contain tungsten or does not contain tungsten as the sole fuel. This is advantageous because tungsten has relatively poor burning characteristics. Particularly when the missile is embodied as a decoy, tungsten is unsuitable as the sole fuel because it burns too slowly for this purpose and not enough IR radiation is emitted when it burns. However, as an addition to a further metal or a further metal alloy with good burning characteristics, tungsten is readily suitable because it has a high density of 19.3 g/cm$^3$ and the addition thereof makes it possible to achieve a high density of the mixture.

The density of the mixture can be at least 7 g/cm$^3$, in particular at least 7.85 g/cm$^3$, in particular at least 8 g/cm$^3$, in particular at least 9 g/cm$^3$, in particular at least 10 g/cm$^3$. 7.85 g/cm$^3$ is the density of conventional steel. A mixture having at least the density of steel makes it possible for the nose weight, which is usually formed of steel, to be replaced by the mixture, without having to make significant changes to the geometry of the missile for this purpose. In the case of non-propelled, i.e. kinematic, missiles according to the invention, the increase in the density of the mixture makes it possible to lengthen the range and the duration of the stable flight, and the target accuracy to be achieved with the missile may thereby be increased.

According to a further embodiment of the invention, the pyrotechnic charge is disposed only in the front half of the missile in the direction in which the latter flies, in particular only in the front third thereof, in particular only in the front quarter thereof, in particular only in the front fifth thereof. The direction in which the missile flies is predefined by the configuration of the missile, in particular the aerodynamic shape thereof. The further the center of gravity of the missile is displaced forwards, the better the flying characteristics of the missile.

In one embodiment of the invention, the missile is constructed as a decoy, which emits IR radiation in flight as a result of the pyrotechnic charge burning, or as a shell, in particular a small-caliber shell. If the missile is constructed as a decoy, the pyrotechnic charge has the major advantage that it firstly provides a high weight, which stabilizes the flight path of the missile, and secondly burns, so that no or no significant mass remains which can fall uncontrolled to the ground and thereby cause damage. In this case, the amount of the mixture is preferably such that it can burn completely in the air. Deceleration of the missile due to the aerodynamic drag thereof is less than in the case of missiles having pyrotechnic masses of relatively low density. The IR radiation emitted as a result of the pyrotechnic charge burning can be black-body radiation.

If the missile is a shell, for example a small-caliber shell, the pyrotechnic charge makes it possible to obtain a higher density than in the case of conventional shells formed of steel and thus a longer range with improved target accuracy. In this case, the pyrotechnic charge may be present in the shell or may at least partially form the shell. In the latter case, the pyrotechnic charge is not surrounded by a metal casing, but instead itself also forms the external side of the shell. However, the pyrotechnic charge may be coated in this case, for example with a lacquer, so that it is protected against environmental influences such as moisture.

By setting the impact sensitivity of the pyrotechnic charge, the effect of the shell can be adjusted in such a way that the shell, when it strikes a soft target, merely transmits kinetic energy like a conventional shell, and that the pyrotechnic charge, when the shell strikes a hard target, is ignited by the impact accompanying the strike and is thereby made to burn in the target. A fire can thereby be started in the target. Since the reaction is prevented when the shell strikes a soft target, a shell of this type is also prevented from contravening the Geneva Convention.

When the missile is constructed as a decoy, the missile can have a further pyrotechnic charge, which emits IR radiation when it burns. If this further pyrotechnic charge emits spectral IR radiation when it burns, it is advantageous if this further pyrotechnic charge is made to burn before the pyrotechnic charge. Otherwise, black-body radiation arising when the pyrotechnic charge burns would conceal the spectral radiation and thereby prevent a desirable effect of the decoy. However, if the further pyrotechnic charge, like the pyrotechnic charge, emits black-body radiation, the structure of the missile can also be such that the pyrotechnic charge and the further pyrotechnic charge burn at least partially at the same time. A very strong emission of IR radiation can thereby be effected.

If the missile is constructed as a decoy having a further pyrotechnic charge for producing IR radiation, it is advantageous if the ratio of the density of the pyrotechnic charge to the density of the further pyrotechnic charge is at least 1.9, in particular at least 3, in particular at least 4. This makes it possible to provide a decoy which emits IR radiation for a relatively long time and, at the same time, retains its predefined flight path for a relatively long time.

The missile according to the invention can have a nose which is formed from the pyrotechnic charge. At present, the nose is usually formed of steel. However, the high-density pyrotechnic material is so strong that it can replace the steel nose. This can prevent the nose from remaining after the pyrotechnic charge has been burned. Furthermore, it is possible to use less material and the missile can thereby be produced more inexpensively. The nose can be coated. By way of example, for this purpose the nose can be coated with a lacquer, in particular a lacquer based on phenolic resin or chloroprene. The nose is thereby protected from moisture or mechanical damage, for example. Furthermore, people who handle the missile are protected from toxic substances that may be present in the pyrotechnic charge.

In the case of a missile constructed as a decoy, it is particularly advantageous if the fuel, the oxidizing agent, the binder, if present, and the quantitative ratio between the fuel and the oxidizing agent and the binder, if present, are selected in such a manner that no solid reaction product remains when the mixture is burned. A solid reaction product is understood to mean a reaction product which is solid and can fall to the ground and thus cause significant damage. Within the context of the invention, having no solid reaction product refers to having a liquid reaction product, ash, dust, smoke and particles having a size and/or density that are so low that they are decelerated by their aerodynamic drag, when falling, to such an extent that they cannot cause significant damage on the ground by the transmission of kinetic energy. It is particularly advantageous if the fuel, the oxidizing agent, the binder, if present, and the quantitative ratio between the fuel and the oxidizing agent and the binder, if present, are selected in such a manner that only gaseous and/or smoky reaction products remain when the mixture is burned.

In the case of a missile constructed as a shell, the fuel, the oxidizing agent, the binder, if present, and the quantitative ratio between the fuel and the oxidizing agent and the binder, if present, are preferably selected in such a manner that the mixture can be ignited by impact. Such combinations of fuel, oxidizing agent and possibly binder are known in the prior art. In this regard, the fuel may be zirconium, for example. As an alternative, the pyrotechnic charge can also additionally contain a substance which can be ignited by impact as the fuse. By way of example, the substance can be a mixture of barium peroxide and magnesium or of zirconium and a further oxidizing agent. This makes it possible to provide shells which, depending on the hardness of the target which they strike, transmit to the target only kinetic energy or also the energy released by the pyrotechnic charge being burned.

The fuel, the oxidizing agent, the binder, if present, and the quantitative ratio between the fuel and the oxidizing agent and the binder, if present, are preferably selected in such a manner that the energy density of the mixture is at least 1 kJ/cm$^3$, in particular at least 4 kJ/cm$^3$, in particular at least 8 kJ/cm$^3$, in particular at least 12 kJ/cm$^3$. The higher the energy density of the mixture, the more intense the redox reaction accompanying the burning between the fuel and oxidizing agent and the greater the emission of IR radiation and the fewer the solid residues which are produced.

In one embodiment of the missile according to the invention, the quantitative ratio between the fuel and the oxidizing agent is selected in such a manner that the oxygen balance of the mixture is 0. The energy density of the mixture is thereby maximized with the given fuel and oxidizing agent. If such a high energy density is not required, that component of the mixture having the highest density can be used in excess in order to increase the density of the mixture.

It is particularly advantageous if the mixture is compressed to a density of at least 90%, in particular at least 95%, in particular at least 97%, in particular at least 98%, of the theoretical density of the mixture. In particular, it is thereby also possible for the strength of the mixture to be so high that at least part of the outer surface of the missile can be formed by the mixture.

The metal or the metal alloy can include hafnium, zirconium, tungsten, tantalum, nickel, niobium, titanium, aluminum, boron and/or silicon.

The oxidizing agent preferably includes copper(II) oxide (CuO), lead dioxide ($PbO_2$), samarium trioxide ($Sm_2O_3$), indium trioxide ($In_2O_3$), tungsten trioxide ($WO_3$), tin dioxide ($SnO_2$), nickel oxide (NiO), lanthanum trioxide ($La_2O_3$), cobalt oxide (CoO), iron trioxide ($Fe_2O_3$), manganese dioxide ($MnO_2$), bismuth subnitrate ($Bi_2O_2NO_3$), molybdenum trioxide ($MoO_3$), barium chromate ($BaCrO_4$), strontium chromate ($SrCrO_4$), barium nitrate ($Ba(NO_3)_2$), potassium perchlorate ($KClO_4$) and/or bismuth trioxide ($Bi_2O_3$).

In the case of the missile according to the invention, the metal oxide can also be a mixed oxide. Furthermore, the mixture can be coated, in particular with a lacquer or resin, in particular a phenolic resin or chloroprene. In addition to affording protection from moisture or other environmental influences and protection of people handling the missile from toxic substances which are present, the coating can also have the effect of delaying the ignition of the mixture. Depending on the application, this can be advantageous.

Other features which are considered as characteristic for the invention are set forth in the appended claims.

Although the invention is illustrated and described herein as embodied in a missile having a pyrotechnic charge, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figures 1A, 1B:
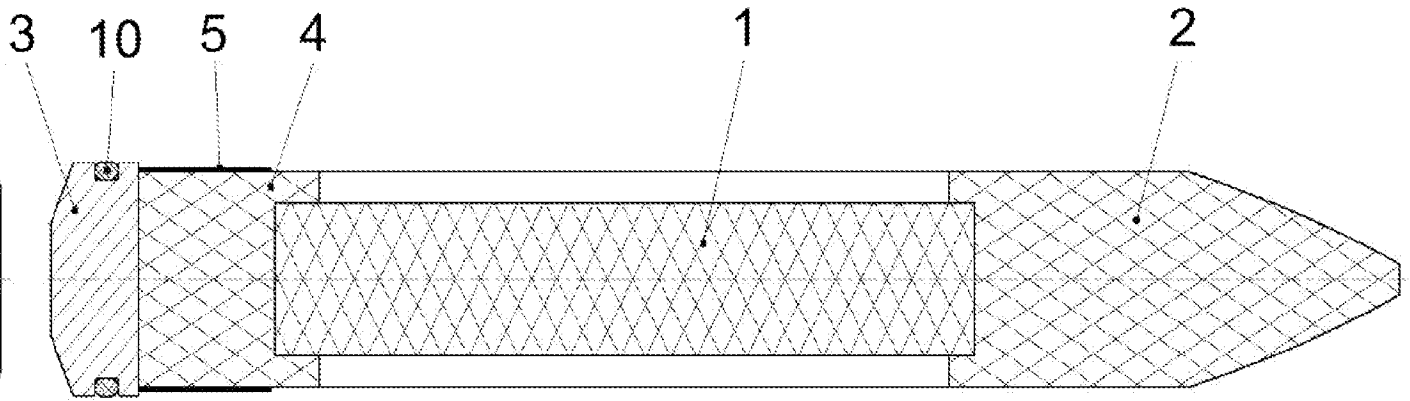
FIGS. 1A and 1B are respective diagrammatic, longitudinal-sectional and rear-elevational views of a missile in a casing, according to the invention.
Figure 2:
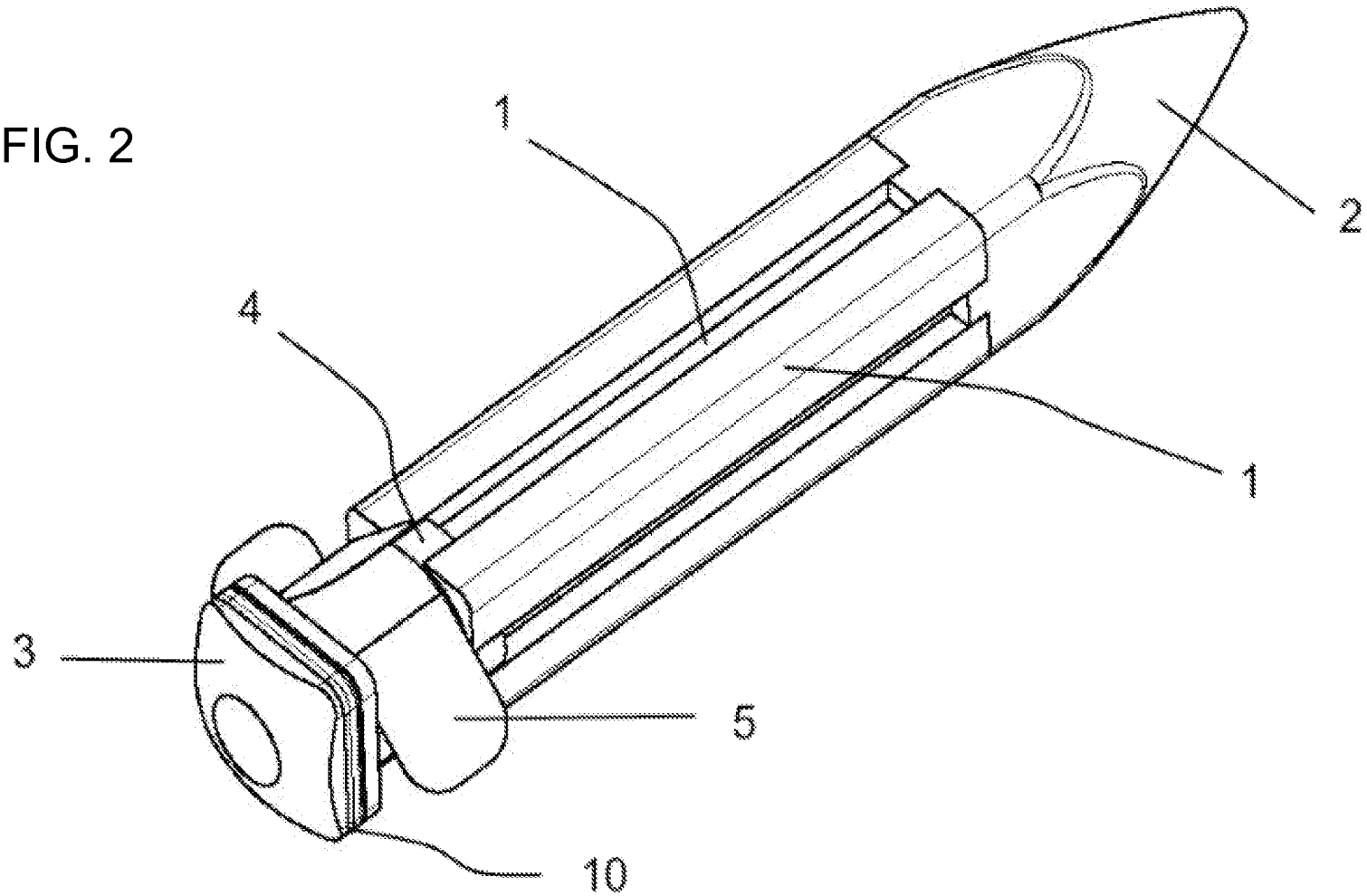
FIG. 2 is a perspective view of the missile according to the invention.

Referring now in detail to FIGS. 1A, 1B and 2 of the drawings as a whole, there is seen a missile according to the invention, which is a decoy. Decoys are missiles which are made to burn and thereby emit IR radiation in flight and, as a result, deflect enemy guided weapons from their actual target, for example an aircraft. In general, the burning lasts only for a few seconds.

The missile is stored in a casing 12, for safe transportation, for safe storage and for protection against moisture or other external influences. The casing 12 can also serve as a launching apparatus. The casing 12 (also referred to as an impulse cartridge) can be seen only in the rear view of FIG. 1B, but not in the sectional illustration of FIG. 1A. FIG. 2 likewise does not show the casing.

A further pyrotechnic charge 1 of the missile shown in FIG. 1A represents a main effective substance thereof. This main effective substance is formed substantially of a mixture which emits black-body radiation during burning and includes, for example, magnesium, Teflon® and fluorinated rubber (Viton). This effective substance (often referred to as MTV) has a density of about 1.9 g/cm$^3$. In the case of the missile according to the invention, the density of the further pyrotechnic charge should not exceed or should not significantly exceed 2 g/cm$^3$, in order to be able to obtain a weight distribution between a pyrotechnic charge 2 and the further pyrotechnic charge 1 which is favorable for flying characteristics of the missile.

The pyrotechnic charge 2 includes a mixture of a metal or a metal alloy as a fuel, a metal oxide as an oxidizing agent and a binder, where the mixture is compressed to a density of at least 85% of the theoretical density and the density of the mixture is at least 6 g/cm$^3$. The pyrotechnic charge 2 can thereby be used as the nose weight and a length ratio between the pyrotechnic charge 2 and the further pyrotechnic charge 1 of about 1 to 2 can be realized, i.e. the length of the heavy part is about one third of the total length of the two pyrotechnic charges 1 and 2. This has proved to be particularly beneficial for the flying characteristics.

Furthermore, the missile has an effective substance 4 with the same composition as the main effective substance in the further pyrotechnic charge 1. Wings 5 of a fin assembly are disposed on the outside of the effective substance 4. These wings, which can be clearly seen in FIG. 2, stabilize the flight attitude of the missile. A conventional safe and arm device 3, which is fixedly connected to the effective substance 4 and is intended to prevent undesired ignition, is disposed at the rear end of the missile. A seal 10 is provided in a groove on the safe and arm device 3. In this case, the seal 10 serves to prevent hot combustion gases from flowing past the safe and arm device 3 when the missile is launched in the casing 12, and from thereby prematurely igniting the effective substance 4, the further pyrotechnic charge 1 and/or the pyrotechnic charge 2. Furthermore, a higher muzzle velocity can be achieved during launching by preventing the combustion gases from flowing past.

Apart from a non-illustrated ignition device, the wings 5 which form the fin assembly and the anti-slide device 3 with the seal 10, the overall missile shown in FIG. 2 includes the pyrotechnic charge 2, the further pyrotechnic charge 1 and the effective substance 4. In order to achieve delayed ignition during use, the effective substance 4 and/or at least part of the further pyrotechnic charge 1 can be coated. A lacquer also protects against the influence of moisture.

The relatively high density of the pyrotechnic charge 2 keeps the flight attitude of the decoy shown herein stable. In flight, the further pyrotechnic charge 1 and the pyrotechnic charge 2 are ignited by the non-illustrated ignition device and thereby emit infrared radiation. The effective substance 4 is ignited by the further pyrotechnic charge 1, which is already burning. The pyrotechnic charge 2 is preferably configured, and is possibly ignited in a delayed manner by a coating, in such a manner that it is at least partially retained throughout the burning process. As a result of its high density, it can thus stabilize the flight attitude until the end of the burning process. At the end of the burning process, the pyrotechnic charge 2, the further pyrotechnic charge 1 and the effective substance 4 have been burned completely in flight, in such a way that merely the anti-slide device 3 with the seal 10 and the wings 5 remain as small unburnt masses, which cannot cause significant damage when they fall to the ground.

The mixture present in the missile according to the invention can have the following compositions, where "tungsten-zirconium" is a mixture of 50% by weight tungsten and 50% by weight zirconium:

1. 70 g lead dioxide, 20 g tungsten-zirconium and 10 g PTFE. The mixture has a density of 6.83 g/cm$^3$. The mixture burns in a vigorous reaction and in the process gasifies completely and without solid residue.
2. 82 g bismuth trioxide, 18 g tungsten-zirconium and 10 g PTFE. The mixture has a density of 6.21 g/cm$^3$. It burns readily and in the process leaves a liquid slag behind.
3. 56.6 g copper oxide, 42.1 g tungsten-zirconium and 1.3 g fluorinated rubber (Viton®). "Viton" is a trademark of DuPont Performance Elastomers for fluorinated rubber. The mixture has a theoretical density of 7.13 g/cm$^3$. The actual density achieved by compression is 7.01 g/cm$^3$. The mixture is readily ignitable, burns readily and leaves a liquid residue behind.
4. 66.3 g lead dioxide, 32.7 g tungsten-zirconium and 1.0 g Viton. The mixture has a theoretical density of 9.11 g/cm$^3$. The actual density achieved by compression is 8.38 g/cm$^3$. The mixture is readily ignitable, burns readily and quickly and in the process gasifies completely without leaving a solid residue behind.
5. 73.7 g bismuth trioxide, 25.2 g tungsten-zirconium and 1.0 g Viton. The mixture has a theoretical density of 8.72 g/cm$^3$. The actual density achieved by compression is 7.75 g/cm$^3$. The mixture is readily ignitable and burns readily. In the process, it leaves a liquid residue behind. The mixture burns more slowly than the mixture specified in item 4.
6. 53.8 g nickel oxide and 46.2 g tungsten-zirconium. The mixture has a theoretical density of 7.79 g/cm$^3$. The density actually achieved by compression is 7.45 g/cm$^3$. The mixture is readily ignitable, burns quickly and in the process leaves liquid and solid residues behind. Similarly to thermite, it burns virtually without a flame.
7. 95.8 g bismuth trioxide and 4.2 g boron. The mixture has a theoretical density of 7.95 g/cm$^3$. The actual density achieved by compression is 7.31 g/cm$^3$. The mixture is very readily ignitable, burns readily and quickly and in the process leaves a liquid residue behind.
8. 94.2 g lead dioxide and 5.8 g boron. The mixture has a theoretical density of 7.97 g/cm$^3$. The density actually achieved by compression is 7.57 g/cm$^3$. The mixture is very readily ignitable, burns vigorously and quickly with a large flame and in the process does not leave a solid residue behind.
9. 57.5 g lead dioxide, 41.6 g hafnium and 0.9 g Viton. The mixture has a theoretical density of 10.27 g/cm$^3$. The density actually achieved by compression is 10.1 g/cm$^3$ and is thus very close to the theoretical density. The mixture is very readily ignitable and burns vigorously with a large flame. This produces dense smoke. No solid residue remains.
10. 66.0 g bismuth trioxide, 33.1 g hafnium and 0.9 g Viton. The mixture has a theoretical density of 9.59 g/cm$^3$. The density actually achieved by compression is 8.53 g/cm$^3$. The mixture is readily ignitable, burns quickly and with a large flame and in the process leaves a liquid residue behind.
11. 68.3 g lead dioxide, 29.1 g tungsten, 1.7 g boron and 0.9 g Viton. The mixture has a theoretical density of 9.97 g/cm$^3$. The density actually achieved by compression is 9.37 g/cm$^3$. The mixture is readily ignitable, burns quickly and with a large smoky flame and in the process leaves a small amount of a liquid residue behind. The mixture can be produced much more favorably than mixtures containing hafnium.

The invention claimed is:

1. A missile constructed as a decoy, the missile comprising:

a front half having a nose in a flying direction of the missile;

a pyrotechnic charge disposed only in said front half and forming said nose, said pyrotechnic charge configured to burn deflagratively upon a designated usage and structure of the missile and to emit IR radiation in flight as a result of burning of said pyrotechnic charge, causing the missile to act as a decoy;

said pyrotechnic charge including a mixture containing at least one metal or a metal alloy as a fuel and at least one metal oxide as an oxidizing agent, said fuel and said oxidizing agent being selected to react with one another by burning;

said mixture being compressed to a density of at least 85% of a theoretical density of said mixture; and said fuel, said oxidizing agent and a quantitative ratio between said fuel and said oxidizing agent being selected to result in a density of said mixture of at least 6 g/cm$^3$.

2. The missile according to claim 1, wherein said mixture additionally contains at least one binder.

3. The missile according to claim 1, wherein said at least one binder is at least one of polytetrafluoroethylene (PTFE) or fluorinated rubber (Viton).

4. The missile according to claim 1, wherein said mixture does not contain tungsten or does not contain tungsten as the sole fuel.

5. The missile according to claim 1, wherein said density of said mixture is at least 7 g/cm$^3$.

6. The missile according to claim 1, wherein said density of said mixture is at least 7.85 g/cm$^3$.

7. The missile according to claim 1, wherein said density of said mixture is at least 8 g/cm$^3$.

8. The missile according to claim 1, wherein said density of said mixture is at least 9 g/cm$^3$.

9. The missile according to claim 1, wherein said density of said mixture is at least 10 g/cm$^3$.

10. The missile according to claim 1, wherein said pyrotechnic charge is disposed only in a front third of the missile in a flying direction of the missile.

11. The missile according to claim 1, wherein said pyrotechnic charge is disposed only in a front quarter of the missile in a flying direction of the missile.

12. The missile according to claim 1, wherein said pyrotechnic charge is disposed only in a front fifth of the missile in a flying direction of the missile.

13. The missile according to claim 1, wherein the missile is constructed as a decoy and has a further pyrotechnic charge emitting IR radiation upon burning.

14. The missile according to claim 13, wherein a ratio of a density of said pyrotechnic charge to a density of said further pyrotechnic charge is at least 1.9.

15. The missile according to claim 13, wherein a ratio of a density of said pyrotechnic charge to a density of said further pyrotechnic charge is at least 3.

16. The missile according to claim 13, wherein a ratio of a density of said pyrotechnic charge to a density of said further pyrotechnic charge is at least 4.

17. The missile according to claim 1, wherein said nose is coated.

18. The missile according to claim 2, wherein the missile is constructed as a decoy, and said fuel, said oxidizing agent and optionally said at least one binder and a quantitative ratio between said fuel, said oxidizing agent and optionally said at least one binder are selected to ensure that no solid reaction product remains when said mixture is burned.

19. The missile according to claim 2, wherein the missile is constructed as a decoy, and said fuel, said oxidizing agent and optionally said at least one binder and a quantitative ratio between said fuel, said oxidizing agent and optionally said at least one binder are selected to ensure that only at least one of gaseous or smoky reaction products remain when said mixture is burned.

20. The missile according to claim 2, wherein said fuel, said oxidizing agent and optionally said at least one binder and a quantitative ratio between said fuel, said oxidizing agent and optionally said at least one binder are selected to ensure that an energy density of said mixture is at least 1 $kJ/cm^3$.

21. The missile according to claim 2, wherein said fuel, said oxidizing agent and optionally said at least one binder and a quantitative ratio between said fuel, said oxidizing agent and optionally said at least one binder are selected to ensure that an energy density of said mixture is at least 4 $kJ/cm^3$.

22. The missile according to claim 2, wherein said fuel, said oxidizing agent and optionally said at least one binder and a quantitative ratio between said fuel, said oxidizing agent and optionally said at least one binder are selected to ensure that an energy density of said mixture is at least 8 $kJ/cm^3$.

23. The missile according to claim 2, wherein said fuel, said oxidizing agent and optionally said at least one binder and a quantitative ratio between said fuel, said oxidizing agent and optionally said at least one binder are selected to ensure that an energy density of said mixture is at least 12 $kJ/cm^3$.

24. The missile according to claim 1, wherein a quantitative ratio between said fuel and said oxidizing agent is selected to ensure that an oxygen balance of said mixture is 0.

25. The missile according to claim 1, wherein said mixture is compressed to a density of at least 90% of the theoretical density of said mixture.

26. The missile according to claim 1, wherein said mixture is compressed to a density of at least 95% of the theoretical density of said mixture.

27. The missile according to claim 1, wherein said mixture is compressed to a density of at least 97% of the theoretical density of said mixture.

28. The missile according to claim 1, wherein said mixture is compressed to a density of at least 98% of the theoretical density of said mixture.

29. The missile according to claim 1, wherein said at least one metal or metal alloy is at least one substance selected from the group consisting of hafnium, zirconium, tungsten, tantalum, nickel, niobium, titanium, aluminum, boron and silicon.

30. The missile according to claim 1, wherein said oxidizing agent includes at least one substance selected from the group consisting of copper(II) oxide ($CuO$), lead monoxide ($PbO$), lead dioxide ($PbO_2$), red lead ($Pb_3O_4$), samarium trioxide ($Sm_2O_3$), indium trioxide ($In_2O_3$), tungsten trioxide ($WO_3$), tin dioxide ($SnO_2$), nickel oxide ($NiO$), lanthanum trioxide ($La_2O_3$), cobalt oxide ($CoO$), iron trioxide ($Fe_2O_3$), manganese dioxide ($MnO_2$), bismuth subnitrate ($Bi_2O_2NO_3$), molybdenum trioxide ($MoO_3$), barium chromate ($BaCrO_4$), strontium chromate ($SrCrO_4$), barium nitrate ($Ba(NO_3)_2$), potassium perchlorate ($KClO_4$) and bismuth trioxide ($Bi_2O_3$).

31. The missile according to claim 1, wherein said at least one metal oxide is a mixed oxide.

32. The missile according to claim 1, wherein said mixture is coated.

33. The missile according to claim 1, wherein said mixture is coated with a lacquer or resin.

34. The missile according to claim 1, wherein said mixture is coated with a phenolic resin or chloroprene.

* * * * *